US006952851B1

(12) United States Patent
Mahoney

(10) Patent No.: US 6,952,851 B1
(45) Date of Patent: Oct. 11, 2005

(54) MATTRESS WITH TRANSPARENT COVER

(75) Inventor: Danny D. Mahoney, Carson City, NV (US)

(73) Assignee: Vinyl Products Manufacturing, Inc., Carson City, NV (US)

( * ) Notice: Subject to any disclaimer, the term of this patent is extended or adjusted under 35 U.S.C. 154(b) by 0 days.

(21) Appl. No.: 10/783,907

(22) Filed: Feb. 20, 2004

(51) Int. Cl.[7] ..... A47C 27/08
(52) U.S. Cl. ..... 5/690; 5/706; 5/712
(58) Field of Search ..... 5/690, 706, 707, 5/711, 712, 737

(56) References Cited

U.S. PATENT DOCUMENTS 4,136,412 A * 1/1979 Wilhelm ..... 5/417
4,267,611 A * 5/1981 Agulnick ..... 5/713
4,638,518 A * 1/1987 Barbulla ..... 5/687
4,670,923 A * 6/1987 Gabriel et al. ..... 5/424
4,737,998 A * 4/1988 Johnson, Sr. ..... 5/422
4,742,437 A * 5/1988 Downey ..... 5/666
4,826,715 A * 5/1989 Lee ..... 428/64.1
4,885,811 A * 12/1989 Hayes ..... 5/81.1 T
4,914,761 A * 4/1990 Boyd ..... 5/688
5,001,792 A * 3/1991 Strobel ..... 5/675
5,109,559 A * 5/1992 West ..... 5/668
5,226,384 A * 7/1993 Jordan ..... 119/28.5
5,632,055 A * 5/1997 Graf ..... 5/706
6,073,291 A * 6/2000 Davis ..... 5/711
6,161,240 A * 12/2000 Huang ..... 5/710
6,260,222 B1 * 7/2001 Lin ..... 5/709
6,428,865 B1 * 8/2002 Huang ..... 428/35.7

* cited by examiner

*Primary Examiner*—Robert G. Santos
(74) *Attorney, Agent, or Firm*—Harris Zimmerman

(57) ABSTRACT

A sleeping mattress construction provides a mattress cover that is fabricated from a transparent material so that the interior of the mattress may be visualized to prevent concealment therein of contraband. In one embodiment the mattress is an air mattress formed of transparent polymer, such as transparent PVC Vinyl sheet material. In another embodiment the mattress is filled with any acceptable filling material or device and enclosed with a transparent cover.

1 Claim, 2 Drawing Sheets

MATTRESS WITH TRANSPARENT COVER

CROSS-REFERENCE TO RELATED APPLICATIONS

Not applicable.

FEDERALLY SPONSORED RESEARCH

Not applicable.

SEQUENCE LISTING, ETC ON CD

Not applicable.

BACKGROUND OF THE INVENTION

1. Field of the Invention

This invention relates to a mattress construction and, more particularly, to a mattress having a transparent cover.

2. Description of Related Art

Modern mattresses may trace their development all the way back to ancient man. Some commentators believe that the mattress evolved from the practice of sleeping on a pile of animal skins or woven rugs. It is equally likely that mattresses arose from the practice of arranging layers of soft moss or pine needles or straw for more comfortable sleeping. It is not hard to imagine that early man thought to maintain a comfortable sleeping arrangement by placing the masses of soft material into a cover that kept the material together and in place. Thus the concept of a mattress may have begun.

A mattress is generally comprised of an outer cover or ticking and an inner core that provides resilient support to a body supported thereon. The inner core may comprise a filler such as straw or batting formed of natural and man-made fibers, or expanded foam material, or an inner spring array, or air or water bladders, or virtually combination of these components. The cover encloses the core materials and presents a wearable outer surface that is opaque, ostensibly to hide the inner components and to present a pleasing uniform surface that is more attractive than the view of the inner components.

It is interesting to note than even in the construction of air and water mattresses, the flexible impervious material that forms the bladder(s) is typically a polymer such as polyvinyl that is generally translucent or opaque, but not transparent. Transparent plastic sheet material has been used to form furniture covers, dust covers, and the like, and are generally fashioned to protect the seating surfaces from dirt and wear. To that end, furniture covers often do not completely enclose the item or its components, and are typically provided with zipper closures to enable convenient removal and replacement.

Applicant has made the observation that in jail and prison settings, the mattresses that are provided to inmates are constructed generally along the lines described above; i.e., a cover or ticking surrounding a resilient core layer, the ticking being opaque. It has also been noted that a prison mattress is a likely place where a prisoner may attempt to hide objects and contraband that are possessed in contravention of prison rules. Many things may be concealed within the fill material of a mattress, and it is only necessary to open a small portion of one seam at the edge of a mattress cover to gain access to this hiding place.

BRIEF SUMMARY OF THE INVENTION

The present invention generally comprises a sleeping mattress construction that is particularly adapted for use in prisons, jails and similar institutional settings to thwart the concealment of prohibited objects or substances within the mattress.

A fundamental aspect of the present invention is the provision of a mattress cover or ticking that is fabricated from a transparent material. As a result, any contraband or prohibited items may be easily visible within the mattress cover, so that the mattress is no longer a protected hiding place.

In one aspect, the mattress made in accordance with this invention may be an air mattress formed of an air bladder constructed of transparent polymer, such as transparent PVC Vinyl sheet material having a thickness of around 24 mils or the equivalent. The seams may be heat sealed to retain air pressure and provide support from the entrained air mass under low pressure. Alternatively, the seams may be bonded with an adhesive or a chemical bond in place of heat sealing. Clearly, any attempt to open the mattress to hide anything would result in failure of the mattress and an obvious violation of prison rules. In situations where more than one bladder is employed, or where interior support structures are placed within the bladder, all these components should be formed of transparent flexible material to enable overall visualization of the mattress and its contents.

In another aspect, the mattress made in accordance with this invention may be a mattress filled with any acceptable filling material or device and covered with a transparent cover. The transparent cover may comprise any flexible plastic or polymer material, such as transparent 24 mil PVC Vinyl or the equivalent. The seams may be sewn, heat sealed, or otherwise connected. It is not essential that the seams are airtight. The use of the transparent cover material enables close visual inspection of the contents of the mattress, so that hiding contraband therein is made very difficult. Moreover, in any embodiment of the invention the use of transparent plastic or polymer for the cover material permits the mattress to be very resistant to corrosive or noxious substances, contamination, vermin, and the like. In any embodiment of the invention, the thickness of the flexible plastic material may range from 4 mils to 8 mils for an air bladder construction, up to 50 mils for the heaviest construction.

DETAILED DESCRIPTION OF THE INVENTION

Figure 1:
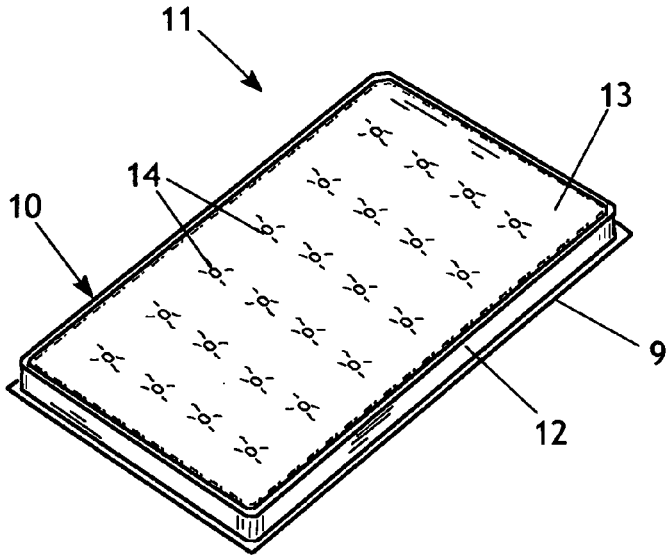
PRIOR ART FIG. 1
FIG. 1 is a perspective view of a typical prior art mattress, depicting its potential as a hiding place for illicit materials and objects.

The present invention generally comprises a sleeping mattress construction that is particularly adapted for use in prisons, jails and similar institutional settings to thwart the concealment of prohibited objects or substances within the mattress. The need for such a mattress will be made apparent with reference to FIG. 1, wherein there is depicted a typical mattress 11 known in the prior art. It is supported on a typical slatted platform 9. The mattress 11 has a generally rectangular layout with a sidewall 12 extending the entire perimeter of the mattress, and top 13 and bottom panels joined to the sidewall 12 in continuous welt-seamed construction to define an enclosed cover 10. Often buttons 14 are added to anchor the top 13 (and bottom) panels to the inner core material of the mattress. The inner core material may be cotton or polyester batting, or expanded polymer materials, or the like. The cover 10 is typically formed of durable cotton fabric, although mattress covers for institutional use may be made of abuse-resistant Nylon or polyester material, or impervious materials such as polyvinyl chloride. In all of these cases the cover material is opaque and does not permit visualization of the interior of the mattress. It is a fairly simple task for an inmate to open a portion of one of the seams, or otherwise form a hole in the cover 10, so that contraband may be hidden within the mattress. Indeed, the seams may be opened and resewn many times for the purpose of hiding and retrieving items that are not permitted under the rules of the institution. This use (or misuse) of prior art mattresses is well-recognized.

Figure 2:
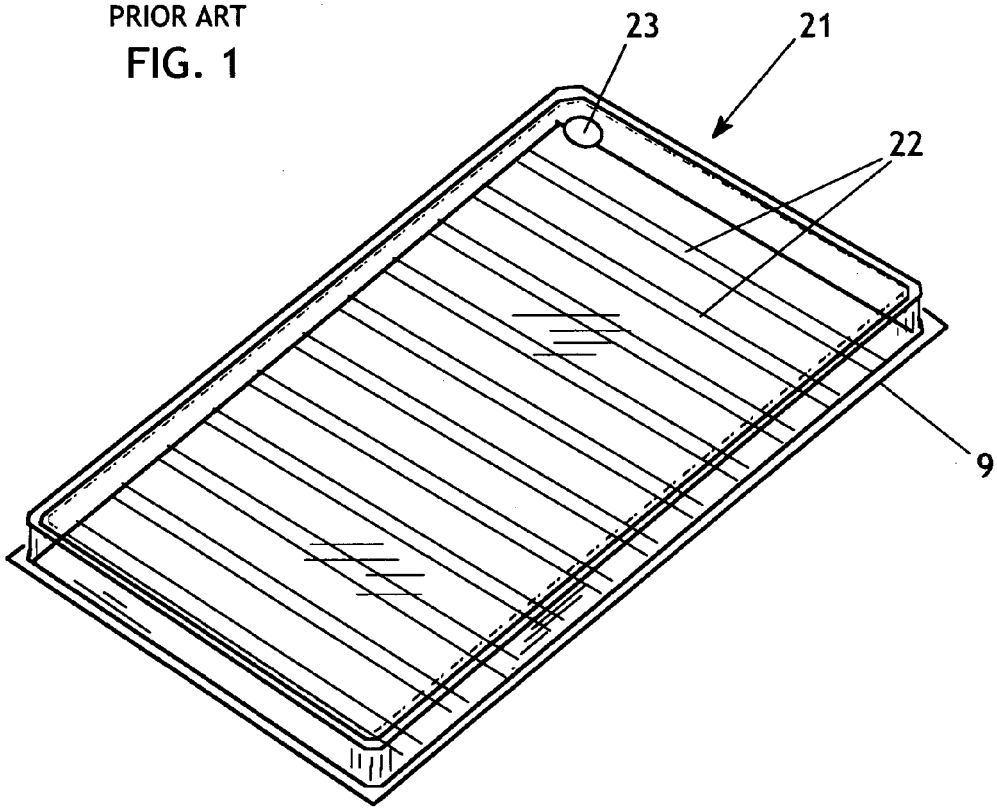
FIG. 2 is a perspective view of one embodiment of the mattress of the invention, in which the mattress is inflatable.

With regard to FIG. 2, one embodiment of the mattress of the invention comprises an air mattress 21 formed as a rectangular envelope having a plan layout similar to the mattress 11 of the prior art and dimensioned to be accommodated and supported by the slatted platform 9 or the like. One possible construction technique involves providing top and bottom panels having matching perimeter edge configurations, with a sidewall extending between the top and bottom panels and having top and bottom edges joined to the matching perimeter edge configurations in continuous fashion to define therewith an enclosed envelope. The rectangular envelope is sealed to define a pressure-containing air bladder, the pressurized air providing resilient support to an individual reclining thereon.

Although the construction details of the mattress 21 are not significant, it is noteworthy that the mattress is defined by sidewalls and top and bottom panels formed of a transparent plastic or polymer material, so that the entire interior of the mattress is visible. This fact is apparent in FIG. 2, in which the slats 22 of the platform 9 are visible through both the top and bottom panels of the mattress 21. Thus any attempt to conceal any illicit item in or under the mattress 21 is doomed to failure.

The transparent plastic or polymer material may comprise transparent PVC Vinyl sheet material having a thickness of around 24 mils or the equivalent. A simple air port 23 known in the prior art may be provided to inflate and deflate the mattress 21. The seams may be heat sealed or otherwise bonded to retain air pressure and provide support from the entrained air mass under low pressure. Clearly, any attempt to open the mattress to hide anything would result in failure of the mattress and an obvious violation of prison rules.

The mattress may be constructed of top and bottom panels joined to a continuous sidewall, or may incorporate simpler or more complicated construction designs. In situations where more than one bladder is employed, or where interior support structures are placed within the bladder, all these components are formed of transparent flexible material to enable overall visualization of the mattress and its contents. Thus the concealment of contraband in mattresses, a major prison problem, may be obviated by the present invention.

Figure 3:
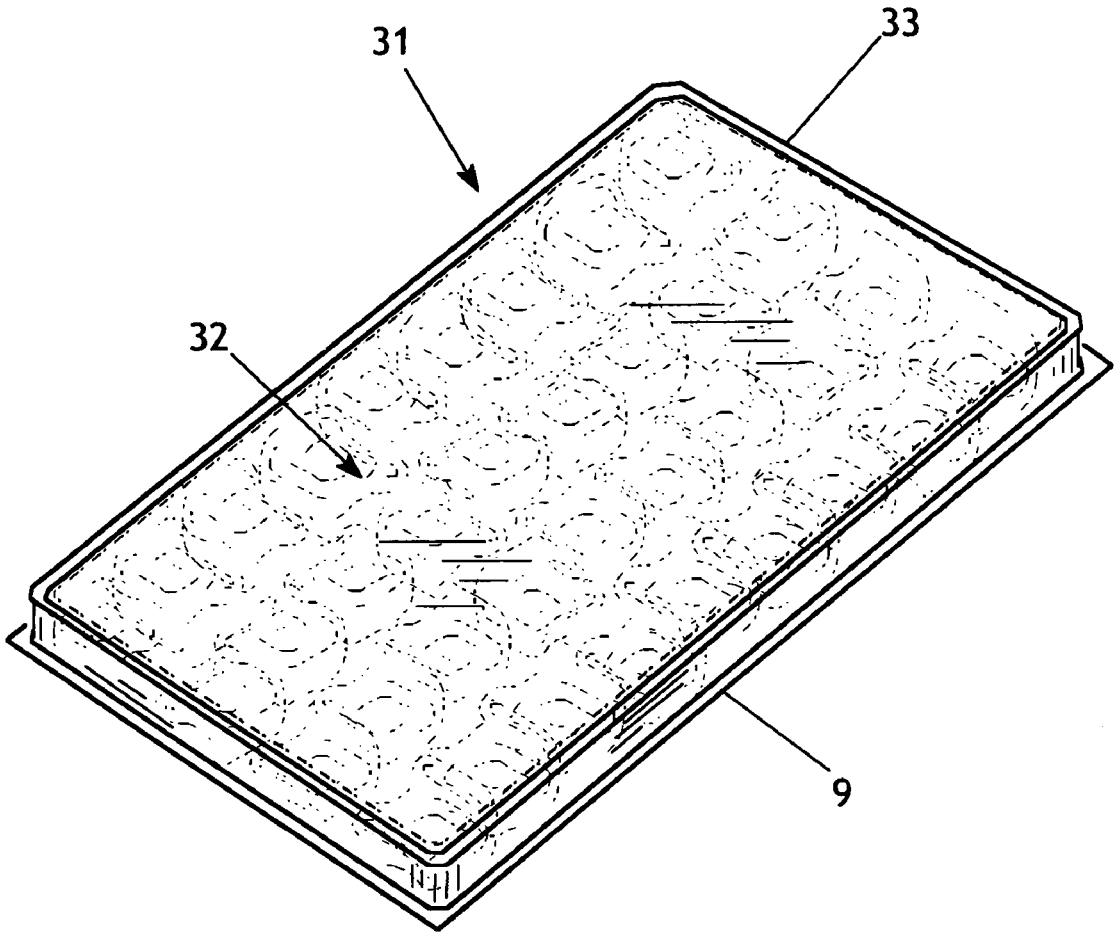
FIG. 3 is a perspective view of another embodiment of the mattress of the invention, in which the mattress is stuffed with resilient materials.

With regard to FIG. 3, another embodiment of the invention generally comprises a mattress 31 that incorporates a batt filling 32 or the like within a transparent cover 33 that entirely encloses and encapsulates the filling 32. The batt filling may comprise natural fiber, cotton batting, polyester batting, expanded foam material, air or water bladders, or the like. As in the previous embodiment, the transparent cover may comprise any flexible plastic or polymer material, such as transparent 24 mil PVC Vinyl or the equivalent. However, the seams that join the components (sidewall, top and bottom panels) need not be heat sealed or otherwise bonded by adhesive or other chemical bonds. Rather, the components may be joined using standard stitching techniques for such plastic or polymer materials. The essential feature of the mattress 31 is that the filling 32 is entirely visible through the transparent cover material, so that there is a greatly reduced opportunity to conceal any contraband substances or items.

In both embodiments described herein, the mattress may be dimensioned to correspond to standard bedding sizes that have been adopted for institutional use, such as jails, prisons, dormitories, military quarters, and any other setting where occupants may attempt to conceal illicit items in bedding. In any embodiment of the invention, the thickness of the flexible plastic material may range from 4 mils to 8 mils for an air bladder construction, up to 50 mils for the heaviest construction.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. A system for preventing concealment of contraband in a bed formed of a mattress resting on a supporting structure, including:

said mattress including an outer cover, said outer cover comprising top and bottom panels formed of a transparent sheet material and sealed in airtight fashion to define at least one air bladder;

said at least one air bladder being supported generally horizontally on said supporting structure and being inflatable to support a human body;

said transparent sheet material permitting visualization of any object in said mattress and directly under said mattress, whereby contraband objects cannot be concealed in said bed;

said top and bottom panels having matching perimeter edge configurations, and a sidewall extending between said top and bottom panels and having top and bottom edges joined to said matching perimeter edge configurations in continuous fashion to define therewith an enclosed envelope; and, interior support features within said pressure-retaining enclosed envelope, said interior support features being formed of transparent material.

* * * * *